US008638962B2

(12) United States Patent
Elmedyb et al.

(10) Patent No.: US 8,638,962 B2
(45) Date of Patent: Jan. 28, 2014

(54) METHOD TO REDUCE FEEDBACK IN HEARING AIDS

(75) Inventors: Thomas Bo Elmedyb, Smørum (DK); Michael Syskind Pedersen, Smørum (DK); Ulrik Kjems, Smørum (DK); Thomas Kaulberg, Smørum (DK)

(73) Assignee: Oticon A/S, Smorum (DK)

( * ) Notice: Subject to any disclaimer, the term of this patent is extended or adjusted under 35 U.S.C. 154(b) by 559 days.

(21) Appl. No.: 12/624,088

(22) Filed: Nov. 23, 2009

(65) Prior Publication Data

US 2010/0128911 A1 May 27, 2010

(30) Foreign Application Priority Data

Nov. 24, 2008 (EP) ..... 08105855

(51) Int. Cl.
*H04R 25/00* (2006.01)

(52) U.S. Cl.
USPC ..... 381/320; 381/312; 381/318; 381/317; 381/60

(58) Field of Classification Search
USPC ..... 381/317, 318, 320, 312, 60
See application file for complete search history.

(56) References Cited

U.S. PATENT DOCUMENTS

| | | | | |
|---|---|---|---|---|
| 4,449,237 | A | 5/1984 | Stepp et al. | |
| 4,852,175 | A * | 7/1989 | Kates | 381/317 |
| 5,033,090 | A * | 7/1991 | Weinrich | 381/318 |
| 5,845,251 | A * | 12/1998 | Case | 704/500 |
| 6,023,517 | A * | 2/2000 | Ishige | 381/315 |
| 6,876,751 | B1 | 4/2005 | Gao et al. | |
| 7,013,015 | B2 * | 3/2006 | Hohmann et al. | 381/318 |
| 7,020,296 | B2 * | 3/2006 | Niederdrank | 381/315 |
| 2004/0190740 | A1 * | 9/2004 | Chalupper et al. | 381/317 |
| 2004/0252855 | A1 * | 12/2004 | Vasserman et al. | 381/331 |
| 2005/0047620 | A1 | 3/2005 | Fretz | |
| 2005/0226447 | A1 | 10/2005 | Miller, III | |
| 2006/0291681 | A1 | 12/2006 | Klinkby et al. | |
| 2007/0076910 | A1 | 4/2007 | Sporer | |
| 2007/0106530 | A1 * | 5/2007 | Blamey et al. | 705/2 |
| 2007/0140506 | A1 | 6/2007 | Roeck et al. | |
| 2009/0041272 | A1 * | 2/2009 | Puder et al. | 381/318 |

FOREIGN PATENT DOCUMENTS

| | | | |
|---|---|---|---|
| EP | 0 823 829 | A2 | 2/1998 |
| WO | WO-2004/105430 | A1 | 12/2004 |

* cited by examiner

*Primary Examiner* — Duc Nguyen
*Assistant Examiner* — Taunya McCarty
(74) *Attorney, Agent, or Firm* — Birch, Stewart, Kolasch & Birch, LLP

(57) ABSTRACT

Disclosed is a method of reducing feedback in a hearing aid adapted to be worn by a user, the method comprising the step of: receiving an audio input signal in an input transducer in the hearing aid; wherein the method further comprises the steps of: transforming the input signal into the frequency domain; dividing the audio signal into a plurality of frequency bands; determining a threshold frequency over which a plurality of upper frequency bands lies; multiplying each of the plurality of upper frequency bands by a random phase, thereby obtaining a plurality of phase randomized upper frequency bands; synthesizing the plurality of phase randomized upper frequency bands and the lower frequency bands to an output signal; transforming the output signal into the time-domain; and transmitting the output signal to an output transducer of the hearing aid.

22 Claims, 3 Drawing Sheets

METHOD TO REDUCE FEEDBACK IN HEARING AIDS

FIELD OF THE INVENTION

This invention generally relates to a method of reducing feedback in hearing aids.

BACKGROUND OF THE INVENTION

Feedback may occur in hearing aids when a loop exists between an audio input transducer, e.g. a microphone, and an audio output transducer, e.g. a loudspeaker or receiver. An audio signal received by the microphone is amplified and transmitted to the loudspeaker, but the sound from the loudspeaker can then be received by the microphone again, amplified further and then transmitted out through the loudspeaker again. This can result in a howl which may be very unpleasant for the hearing aid user and for other people in the surroundings. Furthermore, feedback can decrease the hearing aid user's sound perception. There are different ways to reduce feedback in hearing aids, e.g. by means of changing the phase of the frequency bands of an audio signal.

U.S. Pat. No. 6,876,751 presents a method for band-limited feedback cancellation. The cancellation is limited to a frequency band encompassing all unstable frequencies.

WO04105430 relates to oscillation suppression. A randomly changing phase is applied to the signal in one or more of several frequency bands based on whether oscillation is detected or suspected in the signal or not.

US2005/0226447 relates to oscillation reduction by phase shifting.

US2005/0047620 describes a hearing aid circuit comprising a phase shifter for feedback reduction.

US 2006/291681 A1 deals with a hearing aid comprising an adaptive feedback suppression system. The hearing aid comprises a pair of equalization filters having a frequency selection unit for respectively selecting from the processor input and output signals a plurality of frequency band signals and a frequency equalization unit for frequency equalizing the selected frequency band signals, and an adaptive feedback estimation filter for adaptively deriving the feedback cancellation signal from the equalized frequency band signals.

It remains a problem to improve feedback reduction in hearing aids in order to further improve the sound perception for hearing aid users.

SUMMARY

Disclosed is a method of reducing feedback in a hearing aid adapted to be worn by a user, the method comprising the step of:

receiving an audio input signal in an input transducer in the hearing aid;

wherein the method further comprises the steps of:

transforming the input signal into the frequency domain;

dividing the audio signal into a plurality of frequency bands;

determining a threshold frequency over which a plurality of upper frequency bands lies;

multiplying each of the plurality of upper frequency bands by a random phase, thereby obtaining a plurality of phase randomized upper frequency bands;

synthesizing the plurality of phase randomized upper frequency bands and the lower frequency bands to an output signal;

transforming the output signal into the time-domain; and transmitting the output signal to an output transducer of the hearing aid.

Consequently, it is an advantage that each of the upper frequency bands is multiplied by a random phase, because above some frequency threshold randomization of the phase may not influence the user's perception of the audio signal. The human ear is less sensitive to phase changes in the upper frequency bands, so there is only little perceptual difference between an unmodified audio signal and the same audio signal where the upper frequency bands have been multiplied by a random phase.

Furthermore, it is an advantage that by randomizing the phase in the narrow frequency bands, the probability that feedback will occur in these frequency bands will be minimized. By changing the phase randomly for each frequency band the probability that feedback will occur in these phase randomized frequency bands is very small, and this may improve the sound perception for the hearing aid user.

The human auditory system has a better frequency resolution in the low frequency region and it is thus easier to separate low frequencies from each other than high frequencies. The auditory system is thus far more selective to the frequency content in the low-frequency range compared to the high-frequency range, and it is therefore an advantage that the low-frequency bands are not modified by means of phase randomization.

Low frequency bands may be selected to be lower than e.g. 2 kHz or lower than $f_s/2$ kHz, where $f_s$ is a sampling frequency, depending on the type of audio signal and the means for dividing the audio signal into frequency bands, e.g. a filter-bank.

The term 'multiplying each of the plurality of upper frequency bands by a random phase' is in the present context preferably taken to mean that the magnitudes $|x_i(t)|$ of the signals $x_i(t)$ in a each of the upper frequency bands ($i=p, p+1, \ldots, K$), where K is the number of frequency bands, are multiplied by a random phase. Alternatively, it is taken to mean that the (complex) signals $x_i(t)$ in a each of the upper frequency bands are multiplied by a random phase.

The terms 'a random phase' or 'phase randomized' are taken to mean 'random' or 'randomized', respectively, over time.

The threshold frequency may be determined on basis of the hearing impairment or hearing loss which the user suffers from in order to select a suitable portion of the audio signal to be defined as the upper frequency bands. The hearing impairment may be due to loss of the ability to detect certain frequencies of sound and/or loss of the ability to detect low-level sounds. The hearing sensitivity or hearing threshold that a user has may be measured by means of e.g. an audiometer, behavioural audiograms, electrophysiological tests and/or the like. So the threshold frequency over which a plurality of upper frequency bands lies may be determined by measuring the hearing abilities of the user. Alternatively and/or additionally, the threshold frequency may be determined by means of a psychoacoustic model, the age of the user etc.

In general, the threshold frequency $f_{threshold}$ may take on any value, preferably adapted to the user in question, e.g. his or her hearing impairment. The threshold frequency may further be chosen to be different for a particular user in different listening situations (e.g. different for different hearing aid programs). The threshold frequency may e.g. vary between 1 kHz and $f_s/2$, such as in the range from 1.5 kHz to $f_s/2$, such as in the range from 2 kHz to $f_s/2$. In a preferred embodiment, the threshold frequency is equal to 2.5 kHz or 3.5 kHz or 4.5 kHz or 5.5 kHz.

Furthermore, if the hearing aid user is wearing a hearing aid in both ears (binaural fitting), it may influence the user's perception of an audio signal whether the random phase multiplied to a specific frequency band is identical or different for the two hearing aids. It may be an advantage that the random phase multiplied to a specific frequency band is the same for the two hearing aids. Alternatively, the random phase may be different for the two hearing aids.

In one embodiment the method further comprises dividing the audio signal into a plurality of upper frequency bands by means of a filter-bank.

The filter-bank may perform a Fourier transformation of the received audio signal function in order to transform the audio signal to the frequency domain from the time domain. An advantage of the embodiment is that narrow frequency bands may be provided by the filter-bank.

The filter-bank may comprise a fast Fourier transform based filter-bank which may have a high number of frequency channels, and the audible effects of the randomization for the hearing aid user are hereby very small. When the phase is randomized in very narrow bands, the probability that feedback will occur in these phase randomized frequency bands is minimized.

It is to be understood that the randomization process applied to the phase(s) $\phi$ of the signals of the upper frequency bands assumes that the magnitude(s) $|X|$ of the signals X ($=|X|\cdot e^{j\Phi}$) of the frequency bands are left unaltered. In the present context, the term 'a random phase' is taken to include a 'constant phase', where all frequencies of a given upper band are allocated a constant phase.

In one embodiment the random phase is different for each of the plurality of upper frequency bands In one embodiment the phase is kept constant for each of the plurality of upper frequency bands.

In one embodiment, at least one of the random phases, e.g. the random phases of a particular upper frequency band, is chosen from the group consisting of angles in the interval [0, $2\pi$[. In an embodiment, the phases $\phi_{ij}$ of an upper band i, where index j=1, 2, . . . , $Nb_j$ (or $\phi$ for a continuous representation) refer to (possible) individual samples of band i, are random numbers between 0 and $2\pi$.

In an embodiment, each upper band i (i=p, p+1, . . . , K) is represented by a single signal value $x_i(t)$ at a given time.

In one embodiment, at least one of the random phases, e.g. the random phases of a particular upper frequency band, is generated from a band-pass filtered white noise signal.

An advantage of this embodiment is that a random phase generated from a band-pass filtered white noise signal will minimise the spectral smearing, which is due to the configuration of the filter-bank, i.e. how the analysis-filter-bank and the synthesis-filter-bank are configured.

In one embodiment the phase is adjusted according to an external input. An external input may for example be an input parameter such as the absolute hearing threshold for the user, and it is thus an advantage that the user's absolute hearing threshold is included in the phase adjustment. The absolute hearing threshold of a user at a given frequency is the minimum sound level of a pure tone (at the given frequency) that the user can hear with no other sound present. Such threshold is typically indicated relative to a hearing threshold of a normally hearing person and graphically presented in an audiogram (relative hearing threshold versus frequency). Often the audiogram (in dB) can be approximated by a graph having a first piece being constant at lower frequencies and a second piece decreasing at higher frequencies (above a specific frequency $f_x$). In an embodiment, the threshold frequency $f_{threshold}$ indicating the border between lower and upper frequencies in the context of the present disclosure is determined relative to the frequency $f_x$ of the audiogram of the user where the downward slope begins.

In an embodiment, the threshold frequency $f_{threshold}$ is equal to said frequency $f_x$. In an embodiment, the threshold frequency $f_{threshold}$ is determined relative to a frequency $f_{HTx}$ above which the relative hearing threshold of a user is above a specific level LTx in the sense that the user's hearing loss compared to a normally hearing person is more than LTx [dB] (e.g. 20 dB or 30 dB or 40 dB). In an embodiment, the threshold frequency $f_{threshold}$ is equal to said frequency $f_{HTx}$. Furthermore, an external input may be such as a wireless signal input from another hearing aid or a remote control to the hearing aid, whereby this can be included in the phase adjustment. In an embodiment, the hearing aid is adapted to wirelessly receive the external signal, e.g. from a contra lateral hearing aid or any other appropriate device (e.g. a programming or fitting device). In an embodiment, the phase (of an upper frequency band of a first hearing aid of a binaural fitting) is adjusted according to a second hearing aid worn by the user. In an embodiment, the phase and the level of a particular frequency band are adjusted according to the phase and level of the corresponding hearing aid of a binaural hearing aid system (wherein the phase adjustment is determined according to the present method). In an embodiment, the external input is received from a contra lateral hearing aid of a binaural fitting and is adapted to provide that the randomized phases (and possibly the levels) of an upper frequency band (such as of a majority of or all of the upper frequency bands) are equal to those of the corresponding band(s) of the contra lateral hearing aid.

In an embodiment, the step of determining a threshold frequency over which a plurality of upper frequency bands lies is based on an output from a voice or speech detector. Alternatively or additionally, it is based on the currently used hearing aid program (which can be manually set or alternatively automatically set according to the prevailing listening situation). Preferably, the threshold frequency is lower for a speech signal (or a signal (or a program adapted for processing signals) comprising a human voice) than for a signal (or a program adapted for processing signals) comprising other sounds, e.g. music. In an embodiment, the threshold frequency is increased by a specific amount (e.g. 2 kHz or 4 kHz) when the signal does not comprise speech (or is expected not to comprise speech) compared to a situation (program) where speech is detected or expected. In an embodiment, no phase randomization is performed when speech is NOT detected or expected.

In one embodiment the step of multiplying each of the plurality of upper frequency bands by a random phase further comprises the steps of:

calculating one or more factors, $\alpha$, $\beta$, from at least one input parameter, where the one or more factors, $\alpha$, $\beta$, are frequency dependent; and adjusting the contribution of at least one randomized phase by means of at least one of the one or more factors, $\alpha$, $\beta$.

An advantage of this embodiment is that by adjusting, e.g. mixing, the contribution of a randomized phase by means of a frequency dependent factor, the feedback reduction can be improved.

In one embodiment the step of adjusting further comprises multiplying the frequency band by at least one of the one or more factors, before the frequency band is multiplied by a random phase.

In this embodiment a factor can be multiplied to a phase randomized upper frequency band, thereby improving the feedback reduction.

In one embodiment the step of adjusting further comprises adding (the frequency band multiplied by) at least one of the one or more factors to the phase randomized upper frequency band.

An advantage of this embodiment is that a factor can be added to a phase randomized upper frequency band, thereby improving the feedback reduction. When a non-randomized upper frequency band is multiplied by a factor and added to the (same) randomized upper frequency band (possibly multiplied by at least one of the one or more factors), a band signal comprising a weighted mixture of randomized and non-randomized versions of the original band signal is provided. The weighting can e.g. be adapted to the hearing impairment of the user and/or to the current listening situation (hearing aid program).

The steps of adjusting the contribution of a randomized phase by means of adding a factor and by means of multiplying a factor can be combined and applied to the same phase randomized upper frequency band.

In one embodiment at least one of the at least one input parameter is chosen from the group consisting of:

- loop gain
- psychoacoustic effect
- absolute hearing threshold
- an external input such as a wireless input from another hearing aid or a remote control.

An advantage of this embodiment is that these input parameters provide information of how and where to change phase factor in order to get an acceptable sound perception for a hearing aid user.

In one embodiment the one or more factors, $\alpha$, $\beta$, are determined according to a psychoacoustic model (e.g. adapted to a particular user). Preferably, the fraction of a band signal that is multiplied by a randomized phase is determined according to the psychoacoustic model, e.g. maximized under the constraint that the randomization is not perceived by the user as disturbing. Thereby the appropriate mixture of randomized and non-randomized versions of the original band signal can be determined.

Psycho-acoustic models of the human auditory system are e.g. discussed in H Hastl, E. Zwicker, Psychoacoustics, Facts and Models, 3rd edition, Springer, 2007, ISBN 10 3-540-23159-5, cf. e.g. chapter 4 on 'Masking', pages 61-110, and chapter 7.5 on 'Models for Just-Noticeable Variations', pages 194-202. A specific example of a psycho-acoustic model is: Van de Par et. al., "A new perceptual model for audio coding based on spectro-temporal masking", Proceedings of the Audio Engineering Society 124th Convention, Amsterdam, The Netherlands, May 2008.

In an embodiment, the at least one input parameter for calculating one or more factors, $\alpha$, $\beta$ for adjusting the contribution of the at least one randomized phase comprises an output from a voice or speech detector. Alternatively, the at least one input parameter is based on the currently used hearing aid program (which can be manually set or alternatively automatically set according to the prevailing listening situation). Preferably, the fraction of a band signal that is multiplied by a randomized phase is larger for a speech signal (or a signal comprising a human voice) than for a signal comprising other sounds, e.g. music. In an embodiment, the fraction of an (unmodified) upper band signal that is multiplied by a randomized phase is 1 for a speech signal, whereas the fraction of the (unmodified) upper band signal that is added to the randomized band signal is 0, when the signal comprises speech (or is expected to comprise speech).

In one embodiment the method further comprises a step of performing a measurement of whether a tone is generated by feedback in the hearing aid or is a sound signal from the surroundings, where the measurement for example is performed by breaking the loop by phase randomization.

The present invention relates to different aspects including the method described above and in the following, and corresponding systems, devices, and/or product means, each yielding one or more of the benefits and advantages described in connection with the first mentioned aspect, and each having one or more embodiments corresponding to the embodiments described in connection with the first mentioned aspect and/or disclosed in the appended claims.

In particular, disclosed herein is a hearing aid adapted to be worn by a user, comprising:

- at least one input transducer adapted to receive an audio input signal;

wherein the hearing aid further comprises:

- means for transforming the input signal into the frequency domain;
- a filter-bank for dividing the audio signal into a plurality of frequency bands;
- means for defining/determining/selecting a threshold frequency over which a plurality of upper frequency bands lies;
- means for multiplying each of the plurality of upper frequency bands by a random phase, thereby obtaining a plurality of phase randomized upper frequency bands;
- means for synthesizing the plurality of phase randomized upper frequency bands and the lower frequency bands to an output signal;
- means for transforming the output signal into the time-domain;
- means for transmitting the output signal to at least one output transducer.

The features of the method described above and in the following may be implemented in software and carried out on a data processing system or other processing means caused by the execution of computer-executable instructions. The instructions may be program code means loaded in a memory, such as a RAM, from a storage medium or from another computer via a computer network. Alternatively, the described features may be implemented by hardwired circuitry instead of software or in combination with software.

According to one aspect a computer program comprising program code means for causing a data processing system to perform the method is disclosed, when said computer program is executed on the data processing system.

In one embodiment a data processing system comprising program code means for causing the data processing system to perform the method is disclosed.

BRIEF DESCRIPTION OF THE DRAWINGS

The above and/or additional objects, features and advantages of the present invention, will be further elucidated by the following illustrative and non-limiting detailed description of embodiments of the present invention, with reference to the appended drawings, wherein.

DETAILED DESCRIPTION

In the following description, reference is made to the accompanying figures, which show by way of illustration how the invention may be practiced.

Figure 1:
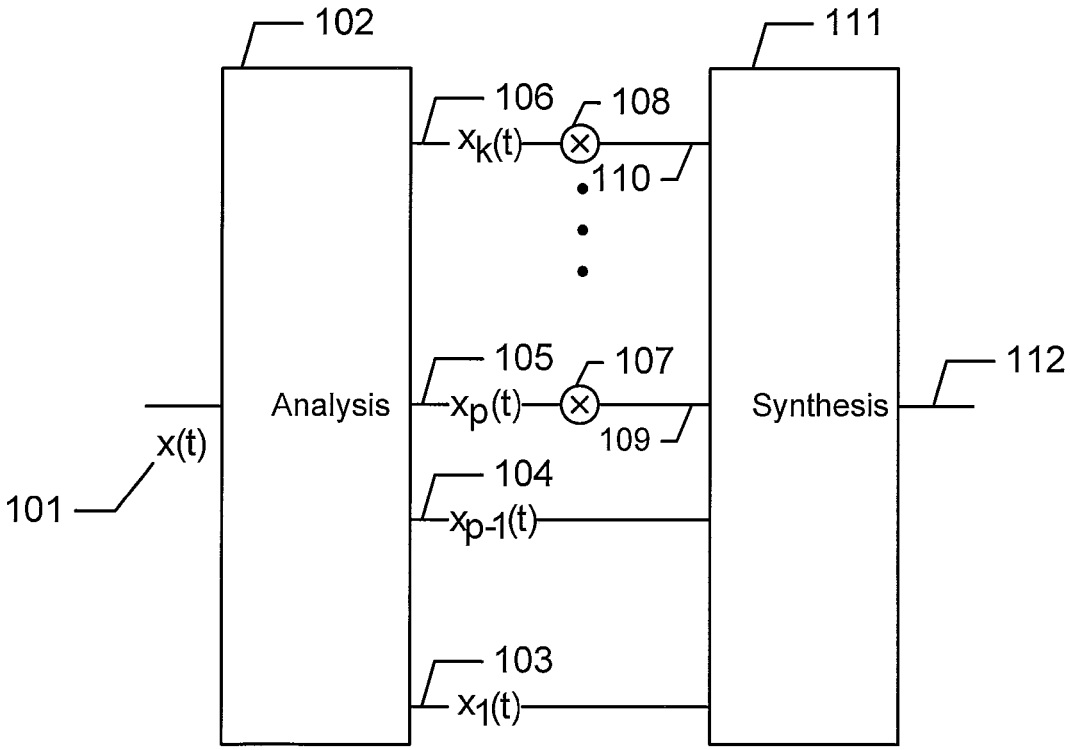
FIG. 1 shows a schematic view of a method of randomizing the phase of upper-frequency bands of an audio signal.

FIG. 1 shows a schematic view of a method of randomizing the phase of upper-frequency bands of an audio signal.

An audio signal x(t) is received in an input transducer of a hearing aid (e.g. either picked up by a microphone or received by a direct electric input, e.g. a wireless input). The audio signal 101 is transformed into the frequency-domain by means of an analysis filter-bank 102. In the analysis filter-bank 102 the audio signal is divided into smaller sequences, i.e. into a number of frequency subbands or channels 103, 104, 105, 106 of the filter-bank. The frequency resolution may be uniform or non-uniform.

A threshold frequency is determined and the frequency bands above this threshold are defined as the K−p+1 upper frequency bands. K is the number of frequency bands, and p is the threshold band. The threshold frequency may be determined by means of a psychoacoustic model, hearing impairment or hearing loss of the user, the age of the user etc. The K−p+1 upper frequency bands, 105, 106 are each multiplied by a random phase 107, 108. The magnitude of the frequency bands/channels is maintained. Given the frequency vector X of the signal and a random phase matrix co, with random numbers between 0 and 2π, the general expression for randomizing the phase in an arbitrary subband is:

$$X^{randomized}=|X|\cdot[\cos(\phi)+i\sin(\phi)]=|X|\cdot\exp(i\phi)$$

Alternatively, the random phase may be generated from a band-pass filtered white noise signal, where the white noise signal is a random signal with a flat power spectral density, i.e. the signal's power spectral density has equal power in any band, at any centre frequency, having a given bandwidth. By generating the random phase from a band-pass filtered white-noise signal, the spectral smearing may be minimized, due to the configuration of the analysis-filter-bank and the synthesis-filter-bank.

The low-frequency bands 103, 104, i.e. $x_1(t)$ to $x_{p-1}(t)$ in FIG. 1, are unmodified. All the frequency bands, i.e. the phase randomized upper frequency bands 109, 110, and unmodified low-frequency bands 103, 104, are synthesized to an output signal 112 and transformed back into the time-domain by a synthesis filter-bank 111.

Alternatively and/or additionally, the upper frequency bands of the audio signals may be defined by means of a threshold frequency $f_{threshold}$ and a sampling frequency $f_s$. The specific value of $f_{threshold}$ indicates a lower threshold frequency, where a certain amount of people cannot hear the difference between the randomized signal and the original signal. Thus above $f_{threshold}$ the randomization of the phase in the upper frequency bands in the frequency domain may not have any perceptual effect for the hearing aid user. The threshold frequency $f_{threshold}$ may e.g. vary between 2 kHz and $f_s/2$, and may e.g. be 2.5 kHz or 3 kHz or 4 kHz, such as 5 kHz. Alternatively, $f_{threshold}$ may have another value.

Alternatively, $f_{threshold}$ may be defined relative to the frequency range of the audio signal, the audio signal being limited to frequencies between a minimum frequency ($f_{min}$) and a maximum frequency ($f_{max}$), e.g. as $f_{min}$ plus a fraction of the range (e.g. 0.5 times ($f_{max}$-$f_{min}$)). The frequency range of a signal may be known in advance for a given acoustic environment (and e.g. determined by the selected program) or may be dynamically determined from the energy content of the different frequency bands as e.g. determined by level detectors in each band or by the magnitude of the frequency units in a time-frequency representation (e.g. whether a magnitude value of a given frequency unit is larger than a minimum value, e.g. for a minimum amount of time, see e.g. EP 2 088 802 A1).

Furthermore, the threshold frequency may depend on the type of received audio signal. The type of signal may be such as female speech, male speech, music etc. Preferably, the threshold frequency is higher for a female (or child) speech signal than for a male speech signal. Preferably, the threshold frequency is higher for a music signal than for a speech signal. A speech signal may be determined from a voice detector. A female or male voice may be determined by analyzing the fundamental frequency of the signal (see e.g. EP 2 081 405 A1).

Furthermore, $f_{threshold}$ may depend on the filter-bank setup, e.g. $f_{threshold}$ may vary between different filter-bank setups.

The analysis filter-bank may consist of analysis filters and decimators with decimation factor D (where the sampling rate in a channel is reduced by a factor of D). The filter-bank may have M=512 channels and may have a decimation factor D=64. The sampling frequency $f_s$ may be any suitable number, e.g. between 6 kHz and 48 kHz. The analysis filter-bank transforms the input signal to a set of M subband signals, which are sampled at a lower rate. The corresponding M-channel synthesis filter-bank consists of synthesis filters and interpolators with interpolation rate equal to D. The task of the synthesis filter-bank is to transform M subband signals to a full band signal, which is sampled at the original higher rate.

The filter-bank may be implemented by a fast Fourier transform (FFT).

With this filter-bank structure it is possible to randomize the phase in narrow frequency bands, and the audible effects for the hearing aid user is hereby small.

Alternatively, the filter-bank may have any number of channels and may have any decimation factor.

Furthermore, the frequency resolution may alternatively be non-uniform.

It is to be understood that even though four frequency bands are shown in FIG. 1, a signal may be divided into any number of frequency bands. Furthermore, even though two frequency bands are shown as upper frequency bands being multiplied by a random phase in FIG. 1, there may be any number of upper frequency bands in a signal.

The random phase being multiplied to the upper frequency bands may be different for each upper frequency band. Alternatively, the random phase may be chosen to be the same across some or all of the upper frequency bands.

If the user is wearing a hearing aid on both ears, the hearing aid in the left and the right ear may thus be adapted to communicate with each other, e.g. wirelessly. In this case the same random phase may be changed by the same amount in the left and the right ear for each upper frequency band, since by applying the same phase in both ears, the difference between the perceived signals may be small compared to the unaltered signal, and this may provide an unaltered sound localization for the user. Alternatively, two different random phases may be applied in the ears for each upper frequency band. When different phases are applied in the left and the right ear, there may be a greater difference in the perceived signals.

Figure 2:
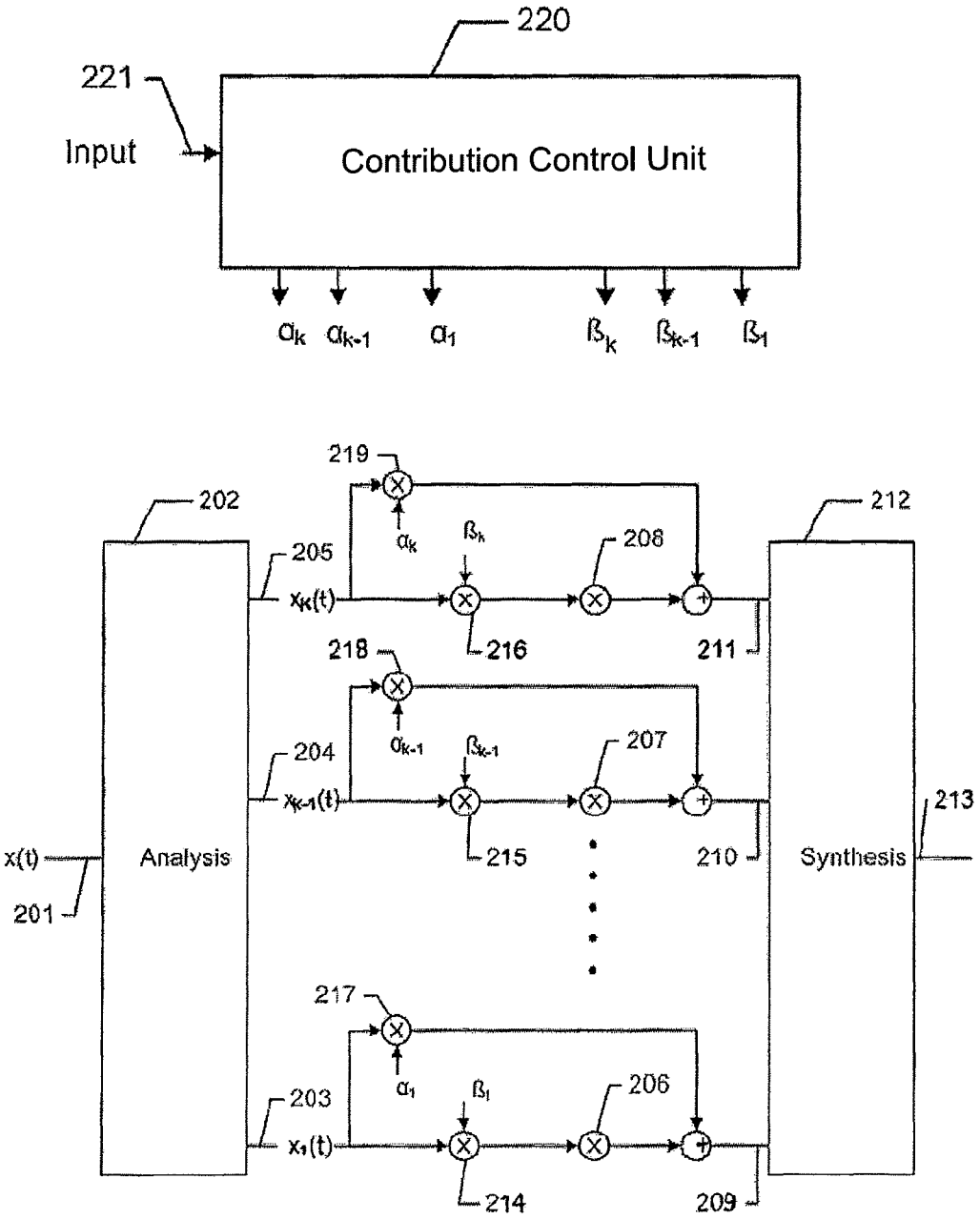
FIG. 2 shows a schematic view of a method of randomizing the phase of frequency bands of an audio signal and applying contribution control.

FIG. 2 shows a schematic view of a method of randomizing the phase of frequency bands of an audio signal and applying contribution control. The phase randomized frequency bands lie above a threshold frequency.

An audio signal x(t) is received in an input transducer or a direct electric input of a hearing aid. The audio signal 201 is transformed into the frequency-domain by means of an analysis filter-bank 202. In the analysis filter-bank 202 the audio signal is divided into smaller sequences, i.e. into a number of frequency subbands or channels of the filter-bank 203, 204, 205. The frequency resolution may be uniform or non-uniform. The frequency bands may each be multiplied by a random phase 206, 207, 208.

Furthermore, the contribution of the randomized phase is adjusted by calculations of input parameters such as psychoacoustic effects, the loop gain and/or the absolute hearing threshold etc.

The phase randomized frequency bands, 209, 210, 211, are synthesized to an output signal 213 and transformed back into the time-domain by a synthesis filter-bank 212.

The threshold frequency divides the frequency bands into upper and lower frequency bands. The upper and lower frequency bands are thus defined relative to this threshold. The threshold frequency may be a low value, whereby a majority of the frequency bands may be defined as upper frequency bands. Alternatively, the threshold frequency may be a high value, whereby a minority of the frequency bands may be defined as upper frequency bands.

Furthermore, the threshold frequency may comprise a smooth transition in the form of an intermediate stage where a weighting of the original phase and the randomized phase is performed. Hereby a sharp or abrupt transition between randomizing and not randomizing the phase may be avoided. The smooth transition may be provided by means of the values of factors $\alpha$ and $\beta$, where $\alpha$ and $\beta$ are determined from input parameters, see below. The limits of the $\alpha$- and $\beta$-values may be defined by e.g. $\alpha=1$ and $\beta=0$ corresponding to no randomization, and $\alpha=0$ and $\beta=1$ corresponding to complete randomization, respectively. The smooth transition may be obtained by means of choosing $\alpha$ and $\beta$ having values between 0 and 1, whereby the resulting phase is a weighting of the original phase and the randomized phase.

The threshold frequency may be determined by measuring the hearing abilities of the user. A hearing impairment may be due to loss of the ability to detect certain frequencies of sound and/or loss of the ability to detect low-level sounds. Alternatively and/or additionally, the threshold frequency may be determined by means of a psychoacoustic model, the age of the user, the type of acoustic signal, etc.

The contribution control comprises mixing signals, e.g. the random phases may be mixed. Frequency bands and the phase randomized frequency bands may be mixed with factors determined from input parameters, e.g. by adding and/or multiplying with factors determined from input parameters. A frequency band may be turned off or turned on by means of the factors determined from input parameters for the respective frequency band. The adjustment of the contribution of the randomized phase may be performed by multiplying a frequency band by a factor $\beta$ which is determined from the input parameters, before the frequency band is multiplied by a random phase. The multiplication of the factor $\beta$ is indicated by 214, 215, 216 in FIG. 2.

Furthermore, the adjustment may be performed by adding a frequency band multiplied by a factor $\alpha$ determined from the input parameters to a frequency band multiplied by the random phase. The addition of the factor $\alpha$ is indicated by 217, 218, 219 in FIG. 2

The factors $\alpha$ and $\beta$ may be frequency specific, and they may be calculated by means of a contribution control unit 220, which receives and/or contains information 221 about the input parameters.

By adjusting the contribution of the randomized phase, the feedback reduction may be further improved.

Figure 3:
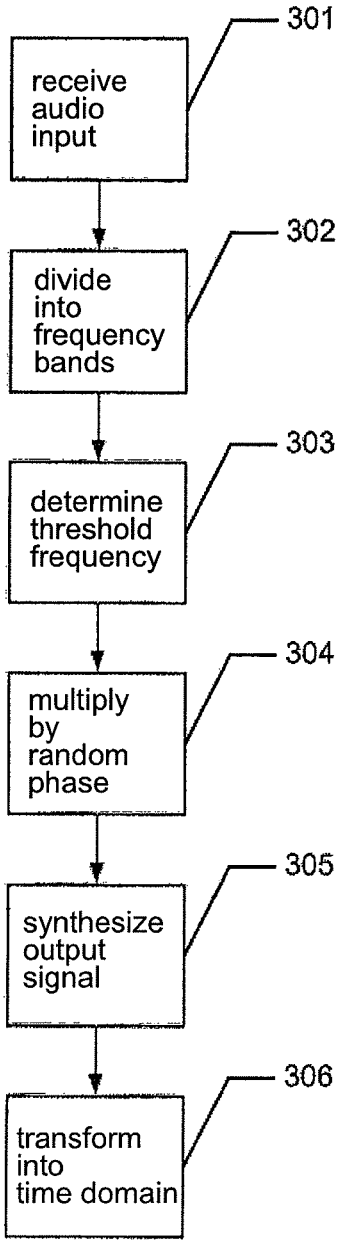
FIG. 3 shows a flowchart of a method of randomizing the phase of upper-frequency bands of an audio signal.

FIG. 3 shows a flowchart of a method of reducing feedback in a hearing aid by randomizing the phase of the upper frequency bands of an audio signal.

In step 301 an audio input signal is received in an input transducer or by a direct electric input in a hearing aid.

In step 302 the audio signal is divided into a plurality of frequency bands by means of the filter-bank.

In step 303 a threshold frequency is determined, and above this threshold frequency lies a plurality of upper frequency bands.

In step 304 each of the plurality of upper frequency bands is multiplied by a random phase, thereby obtaining a plurality of phase randomized upper frequency bands.

In step 305 the plurality of phase randomized upper frequency bands and the lower frequency bands are synthesized to an output signal by means of a synthesis filter-bank.

In step 306 the output signal is transformed into the time-domain by means of the synthesis filter-bank; and the output signal is transmitted to an output transducer of the hearing aid.

Although some embodiments have been described and shown in detail, the invention is not restricted to them, but may also be embodied in other ways within the scope of the subject matter defined in the following claims. In particular, it is to be understood that other embodiments may be utilised and structural and functional modifications may be made without departing from the scope of the present invention.

In device claims enumerating several means, several of these means can be embodied by one and the same item of hardware. The mere fact that certain measures are recited in mutually different dependent claims or described in different embodiments does not indicate that a combination of these measures cannot be used to advantage.

It should be emphasized that the term "comprises/comprising" when used in this specification is taken to specify the presence of stated features, integers, steps or components but does not preclude the presence or addition of one or more other features, integers, steps, components or groups thereof.

The invention claimed is:

1. A method of reducing feedback in a hearing aid adapted to be worn by a user, the method comprising:

receiving an audio input signal in an input transducer in the hearing aid;

transforming the audio input signal into the frequency domain;

dividing the audio input signal into a plurality of frequency bands;

determining a threshold frequency above which a plurality of upper frequency bands lies, said threshold frequency defining a boundary between lower frequency bands and the upper frequency bands, wherein said threshold frequency is different in different listening situations;

multiplying each of the plurality of upper frequency bands by a random phase, thereby obtaining a plurality of phase randomized upper frequency bands;

synthesizing the plurality of phase randomized upper frequency bands and the lower frequency bands to an output signal;

transforming the output signal into time-domain; and transmitting the output signal to an output transducer of the hearing aid.

2. A method according to claim 1, further comprising:

dividing the audio input signal into the plurality of upper frequency bands by a filter-bank.

3. A method according to claim 1, wherein the random phase is different for each of the plurality of upper frequency bands.

4. A method according to claim 1, wherein the random phase is kept constant for each of the plurality of upper frequency bands.

5. A method according to claim 1, wherein at least one of the random phases is chosen from the group consisting of angles in an interval greater than or equal to zero and less than $2\pi$.

6. A method according to claim 1, wherein at least one of the random phases is generated from a band-pass filtered white noise signal.

7. A method according to claim 1, wherein the phase is adjusted according to a second hearing aid worn by the user.

8. A method according to claim 1, wherein the phase is adjusted according to an external input.

9. A method according to claim 1, further comprising:

calculating one or more factors from at least one input parameter, where the one or more factors are frequency dependent; and adjusting a contribution of at least one randomized phase to a frequency band based on at least one of the one or more factors.

10. A method according to claim 9, wherein the adjusting comprises multiplying the frequency band by at least one of the one or more factors, before the frequency band is multiplied by a random phase.

11. A method according to claim 9, wherein the adjusting comprises adding the frequency band multiplied by at least one of the one or more factors to the phase randomized upper frequency band.

12. A method according to claim 9, wherein the at least one input parameter is chosen from the group consisting of:

loop gain;

psychoacoustic effect;

absolute hearing threshold; and a wireless input from another hearing aid or a remote control.

13. A method according to claim 1, further comprising:

performing a measurement of whether a tone is generated by feedback in the hearing aid or a sound signal from the surroundings, where the measurement is performed by breaking a loop by randomizing the phase.

14. A hearing aid adapted to be worn by a user, comprising:

at least one input transducer adapted to receive an audio input signal;

a filter-bank configured to transform the audio input signal into frequency domain and to divide the audio input signal into a plurality of frequency bands;

a processing unit configured to determine a threshold frequency above which a plurality of upper frequency bands lies, said threshold frequency defining a boundary between lower frequency bands and the upper frequency bands, wherein said threshold frequency is different in different listening situations;

a multiplier configured to multiply each of the plurality of upper frequency bands by a random phase, thereby obtaining a plurality of phase randomized upper frequency bands;

a synthesizer configured to synthesize the plurality of phase randomized upper frequency bands and the lower frequency bands to an output signal and to transform the output signal into time-domain; and a connection configured to transmit the output signal to at least one output transducer.

15. A method according to claim 1, further comprising:

selecting different hearing aid programs based on the different listening situations.

16. A method according to claim 1, wherein the threshold frequency is adapted to be variable between 1 kHz and $f_s/2$, where $f_s$ is a sampling frequency.

17. A method according to claim 1, wherein the threshold frequency is determined based on the hearing ability of the user.

18. A method according to claim 1, wherein the threshold frequency is determined by means of a psychoacoustic model.

19. A method according to claim 1, wherein the threshold frequency is based on an output from a voice or speech detector.

20. A method of reducing feedback in a hearing aid system comprising left and right hearing aids, each hearing aid being adapted to be worn by a user and for communicating with each other, the method comprising:

receiving an audio input signal in an input transducer in the hearing aid;

transforming the audio input signal into frequency domain;

dividing the audio input signal into a plurality of frequency bands;

determining a threshold frequency between 1 kHz and $f_s/2$, where $f_s$ is a sampling frequency, a plurality of upper frequency bands being above said threshold frequency, said threshold frequency indicating a border between lower frequency bands and the upper frequency bands;

multiplying each of the plurality of upper frequency bands by a random phase, thereby obtaining a plurality of phase randomized upper frequency bands;

synthesizing the plurality of phase randomized upper frequency bands and the lower frequency bands to an output signal;

transforming the output signal into time-domain; and transmitting the output signal to an output transducer, wherein the same random phase is changed by the same amount in the left and the right hearing aids for each upper frequency band.

21. A hearing aid system comprising left and right hearing aids adapted to communicate with each other, each hearing aid being adapted to be worn by a user and comprising:

at least one input transducer adapted to receive an audio input signal;

a filter-bank configured to transform the audio input signal into frequency domain and to divide the audio input signal into a plurality of frequency bands;

a processing unit configured to determine a threshold frequency between 1 kHz and $f_s/2$ where $f_s$ is a sampling frequency, a plurality of upper frequency bands being above said threshold frequency, said threshold frequency indicating a border between lower frequency bands and the upper frequency bands;

a multiplier configured to multiply each of the plurality of upper frequency bands by a random phase, thereby obtaining a plurality of phase randomized upper frequency bands;

a synthesizer configured to synthesize the plurality of phase randomized upper frequency bands and the lower frequency bands to an output signal and to transform the output signal into time-domain; and a connection configured to transmit the output signal to at least one output transducer, wherein the same random phase is changed by the same amount in the left and the right hearing aids for each upper frequency band.

22. The method according to claim 20, wherein the determining the threshold frequency includes:

measuring hearing abilities of the user;

generating a psychoacoustic model of the user; and setting the threshold frequency based on said hearing abilities, and the psychoacoustic model.

* * * * *